United States Patent [19]

Burke et al.

[11] 4,412,558

[45] Nov. 1, 1983

[54] TURBULATOR

[75] Inventors: Michael J. Burke, Boring; Harry E. Fowler, Corbett, both of Oreg.

[73] Assignee: Western Fuel Reducers, Inc., Troutdale, Oreg.

[21] Appl. No.: 296,198

[22] Filed: Aug. 25, 1981

Related U.S. Application Data

[63] Continuation-in-part of Ser. No. 107,844, Dec. 28, 1979, abandoned.

[51] Int. Cl.[3] ..... F15D 1/02; B01F 15/06

[52] U.S. Cl. ..... 138/38; 122/155 A; 165/179

[58] Field of Search ..... 138/37, 38, 40; 165/179; 122/20 B, 44 A, 155 A

[56] References Cited

U.S. PATENT DOCUMENTS

| | | | |
|---|---|---|---|
| 1,632,888 | 6/1927 | Davis et al. | 138/38 |
| 2,677,394 | 5/1954 | Brinen et al. | 138/38 |
| 2,688,986 | 9/1954 | O'Brien | 138/38 |
| 3,146,851 | 9/1964 | Ludlow et al. | 138/37 |
| 4,044,796 | 8/1977 | Smick | 138/38 |
| 4,269,265 | 5/1981 | Meyer et al. | 138/38 |

FOREIGN PATENT DOCUMENTS

| | | | |
|---|---|---|---|
| 2436959 | 4/1980 | France | 138/38 |

*Primary Examiner*—John W. Shepperd

*Attorney, Agent, or Firm*—Klarquist, Sparkman, Campbell, Leigh, Whinston & Dellett

[57] ABSTRACT

A turbulator comprising a strip of metal formed into a generally zig-zag longitudinal extending element for insertion into a fire tube of a furnace which so deflects gases passing through the tube as to break up laminar flow and thus improve heat transfer. The apices at the junctures of the legs of the element, which contact the interior wall of the fire tube, are rounded both longitudinally and laterally of the length of the strip to insure non-scratch contact with the interior wall during insertion and retraction whereby to prolong the life of the tube by eliminating zones sensitive to corrosion.

6 Claims, 6 Drawing Figures

FIG. 1
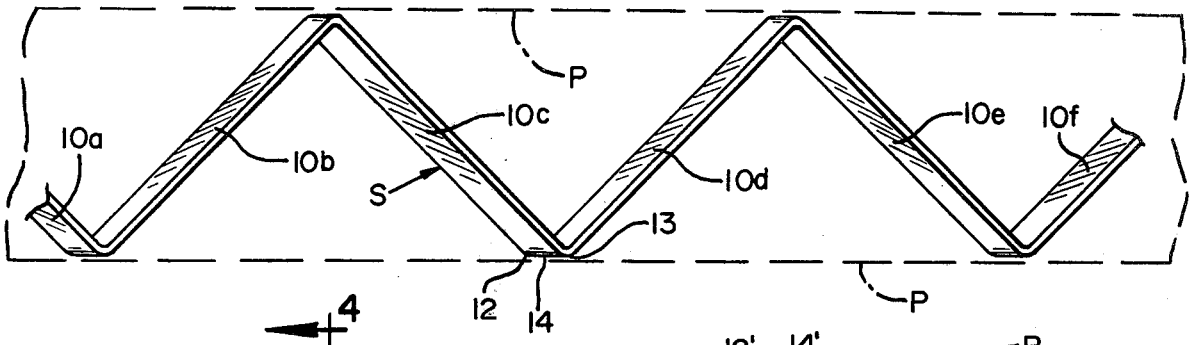
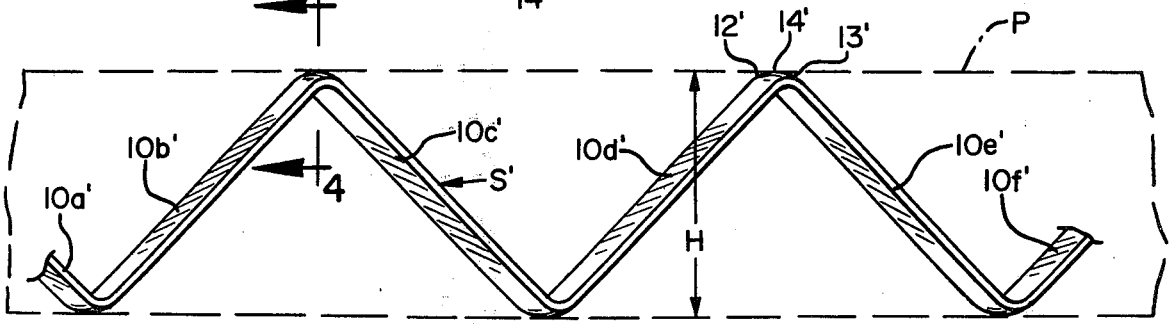
FIG. 2
FIG. 3
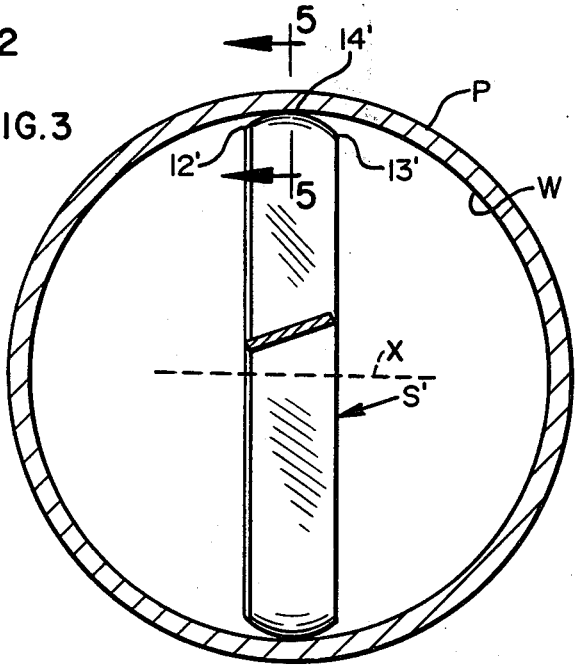
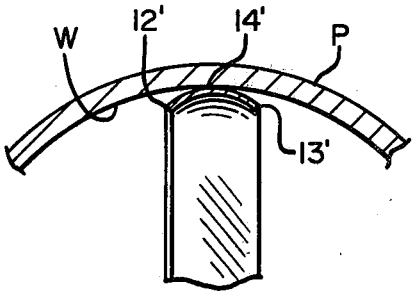
FIG. 4
FIG. 5
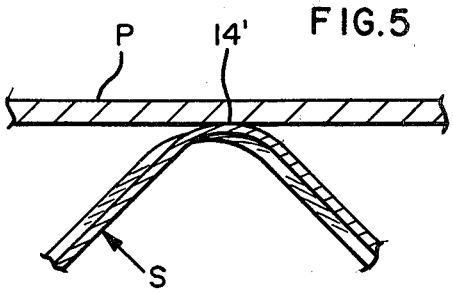
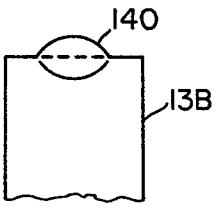
FIG. 6

TURBULATOR

This application is a continuation-in-part or our copending prior application, Ser. No. 107,844, filed Dec. 28, 1979, now abandoned entitled "IMPROVED TURBULATOR."

BACKGROUND OF THE INVENTION

Turbulators for the fire tubes in furnaces are well-known, some of which are shown in the following U.S. Pat. Nos.: 4,044,796 Smick, 2,640,194 Hytte, 2,660,198 Morrow, 3,185,143 Wilson, 2,591,398 Brock, 2,677,394 Brinen et al, 2,688,986 O'Brien.

All of these turbulators have as their purpose to break up laminar flow of gases through the fire tubes so as to improve heat transfer through the walls of the tube to the exterior body of water. In general, these turbulators comprise strips of metal bent into zig-zag form so that when the strip is inserted into a tube, gas passing therethrough will be variously deflected in an attempt to break up laminar flow.

What has not been realized previously is that when inserting the tubes, or later removing them for cleaning purposes, edges on the strips scratch the interior walls of the tubes, setting up areas or zones where corrosion by electrolysis and otherwise can more readily take place than otherwise would be the case. This shortens the life of the tubes. In fact, certain users have refrained from using turbulators because the advantages obtained by greater heat transfer is offset by the shorter life of the tubes.

SUMMARY OF THE INVENTION

The present invention provides a turbulator of zig-zag form in which the apices at the juncture of the legs of the strip are formed to have outwardly directed convex faces which are rounded both longitudinally and laterally so as to insure non-scratch contact with the interior walls of the fire tubes, whereby to avoid scratching the tubes and thereby avoiding setting up areas sensitive to corrosion.

A main object of the present invention is to provide a turbulator having the advantages of the ones presently on the market, but having the additional advantage that it does not scratch or score tubes when inserted or removed therefrom.

FIG. 1 is a view showing in side elevation (not in perspective) a strip bent in zig-zag form having the general shape of a turbulator strip of our invention;

FIG. 2 shows a turbulator strip incorporating the subject matter of our invention;

FIG. 3 is a cross-sectional view through the turbulator of FIG. 2 showing the same within a fire tube;

FIG. 4 is a fragmentary sectional view taken along line 4—4 of FIG. 2;

FIG. 5 is a fragmentary sectional view taken along lines 5—5 of FIG. 3; and FIG. 6 is a fragmentary view of a modified form of the invention.

Referring to FIG. 1, the strip S of metal, preferably of steel, is bent into zig-zag shape along a series of parallel spaced lines, which, rather than being at right angles to the length of strip, are on a bias to such length to provide a series of legs 10*a*–10*f*.

The planes or upper faces of alternate legs are parallel with one another, as are the planes or upper faces of the even legs. Also, the half-planes of adjacent faces form a dihedral angle with one another, so that lines in such planes which are transverse to the length of such faces are parallel to one another. It is further pointed out that the planes of such faces are on a bias to the longitudinal axis of the strip, to cause flowing gases to become turbulent and swirl sufficiently to break up laminar flow, thus to improve heat transfer. However, the amount of turbulence created by such faces is not such as to unduly impair or interfere with the ready through-flow of combustion gases.

FIG. 2 shows a preferred form of our invention where the apices 14' are modified so that they present outwardly directed convex surfaces which are round both longitudinally of the strip (see FIG. 5) and laterally of the strip (see FIGS. 3 and 4). Note that the roundness, laterally speaking, is on a radius less than that of the pipe P to keep the edges 12' and 13' away from the inner wall W of the pipe to insure against scratching or grooving the same upon relative movement of the strip and the pipe. It is pointed out that some relative movement of the strip may occur due to expansion and contraction of the strip in addition to the relative movement caused by inserting or removing a turbulator strip.

As is best shown in FIGS. 3 and 4, each apex is so formed as to present an outwardly facing convex surface including a central area of contact surrounded on all sides by areas of double curvature, with the lateral curvature being centered around an area intermediate the side edges of the strips. It is also evident, particularly from FIG. 3, that the side edges of the strip, at each apex, are located closer to a midplane X through the strip than is said central areas of contact. It is further evident from FIG. 3 that the height of the turbulator is a number of times greater than the width of the strip. It is additionally evident, particularly from FIGS. 3 and 4, that the central areas of contact provide for each apex a single area of contact with the tube, not multiple areas of contact.

FIG. 1 shows that there is a gap between the apices of the turbulator there shown and the interior diameter of the tube, whereas FIG. 2 shows that the apices of the turbulator of FIG. 2 are in direct contact with the interior diameter of the tube. This is also evident in FIGS. 3, 4 and 5. This means that there are no gaps between the apices and the interior diameter of the tube in the inventive device. Thus the flow of air, which will occur longitudinally past the gaps in FIG. 1 is stopped in FIG. 2 to thereby assure better controlled turbulent flow to achieve greater heat transference.

In an alternate form of our invention, the strip is bent along lines which are alternately transverse of the strip and on a bias to the strip. In such an arrangement, an adjacent pair of bias lines, rather than being parallel to one another as in FIG. 1, are oblique to one another. The resulting strip will provide peaked portions alternatingly projecting to one side and to the other of the length of the strip. However, if the metal strip after being so formed is further deformed by applying lateral inward pressure to the projecting peak portions, the resulting structure will provide apex portions which are substantially co-planar with one another. Then, if these apices are further deformed to provide double curvature as depicted in FIGS. 4 and 5, the outwardly facing convex double rounded surfaces so important to the present invention can be provided.

Since the strip is intended to fit within a pipe and usually in contiguous relation to the walls of the pipe, it may be said that if the lateral curvature shown in FIG.

4 is on a radius less than one-half of the height H of the strip, then the edges 12' and 13' will be properly disposed away from the walls W. That is to say, if the height of the strip is equal to the inner diameter of the pipe, then making the radius of the lateral curvature less than one-half the diameter of the pipe is the same as saying making it less than one-half the height of the strip.

The legs in FIG. 2 have been given the same reference numerals as the legs of FIG. 1, but prime marks have been added to distinguish such legs.

Referring now to FIG. 6, it fragmentarily shows a device 138 which is basically shaped like that in FIG. 1, but which at each apex has attached a spherical cap 140 of bronze or other material softer than the steel of the tube into which the turbulator is to be inserted. These bronze caps function much like the rounded apex portions shown in FIG. 3, but have the additional advantage that since the caps are of softer metal than the fire tubes themselves, the danger of scratching is even less than in the case of FIG. 3. Such bronze caps can be hollow or solid and are attached to the zig-zag element 138 by brazing or other suitable manner.

What is claimed is:

1. A turbulator comprising a strip bent into zig-zag form to provide two spaced essentially parallel series of apices for contact with the interior wall of a gas conducting tube, each apex being so formed as to present an outwardly facing convex surface including a central area of contact surrounded on all sides by areas of double curvature, the side edges of the strip at the apices being located closer to the midplane of the strip than are said central areas of contact, the height of the turbulator being a number of times greater than the width of the strip, said central areas of contact providing for each apex a single area of contact with the tube.

2. A turbulator as recited in claim 1 in which such outwardly facing convex surfaces are curved both longitudinally and laterally of the strip, with the lateral curvature being centered about an area intermediate the side edges of the strip.

3. A turbulator as recited in claim 2 in which the curvature laterally is on a radius less than that of the tube to space the side edges of the strip away from the interior wall of the tube.

4. A turbulator as recited in claim 2 in which the curvature laterally is on a radius less than one-half the height of the strip.

5. A turbulator as recited in claim 1, wherein said bent strip provides a series of legs juncturing at the apices of said strip, and wherein the legs are essentially flat in the portions thereof between said apices.

6. A turbulator as recited in claim 1 in which said outwardly facing convex surfaces are provided by a series of bronze caps secured one to each of the apices of the zig-zag strip.

* * * * *